US006116943A

United States Patent [19]

Ferrill et al.

[11] Patent Number: 6,116,943

[45] Date of Patent: Sep. 12, 2000

[54] MODULAR PLUG HAVING A CIRCUIT BOARD

[75] Inventors: Jess Britton Ferrill, Madison; Terry Lee Pitts, Greensboro, both of N.C.

[73] Assignee: The Whitaker Corporation, Wilmington, Del.

[21] Appl. No.: 09/107,814

[22] Filed: Jun. 30, 1998

[51] Int. Cl.[7] ..... H01R 4/24

[52] U.S. Cl. ..... 439/418; 439/676

[58] Field of Search ..... 439/418, 676, 439/347

[56] References Cited

U.S. PATENT DOCUMENTS 5,503,572 4/1996 White et al. ..... 439/676
5,766,027 6/1998 Fogg ..... 439/76.1

OTHER PUBLICATIONS

Abstract and drawings, Serial No. 08/979,805 filed Nov. 25, 1997.
Abstract and drawings, Serial No. 08/977,544 filed Nov. 25, 1997.

*Primary Examiner*—Lincoln Donovan
*Assistant Examiner*—Antoine Ngandjui
*Attorney, Agent, or Firm*—Robert Kapalka

[57] ABSTRACT

A modular plug electrical connector includes a housing and a circuit board having an array of circuit holes. Terminals in the housing have legs that extend into the circuit holes for electrical connection with the circuit board and mechanical retention of the circuit board to the housing. The circuit board carries contacts for terminating wires in a communications system. A stuffer cap has wire channels that receive the wires, and the stuffer cap is pivotable to urge the wires into engagement with the contacts. The wire channels are arranged in siamesed pairs that each receive a twisted wire pair.

17 Claims, 6 Drawing Sheets

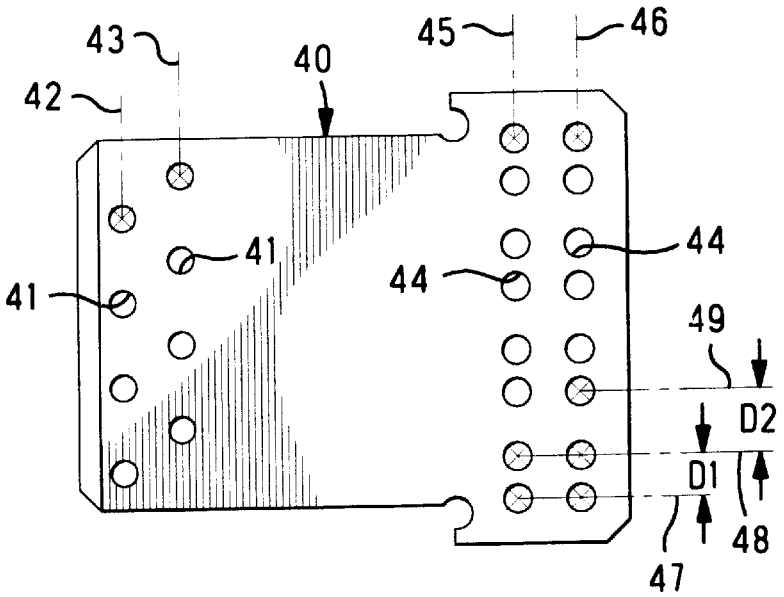
FIG. 5
FIG. 6
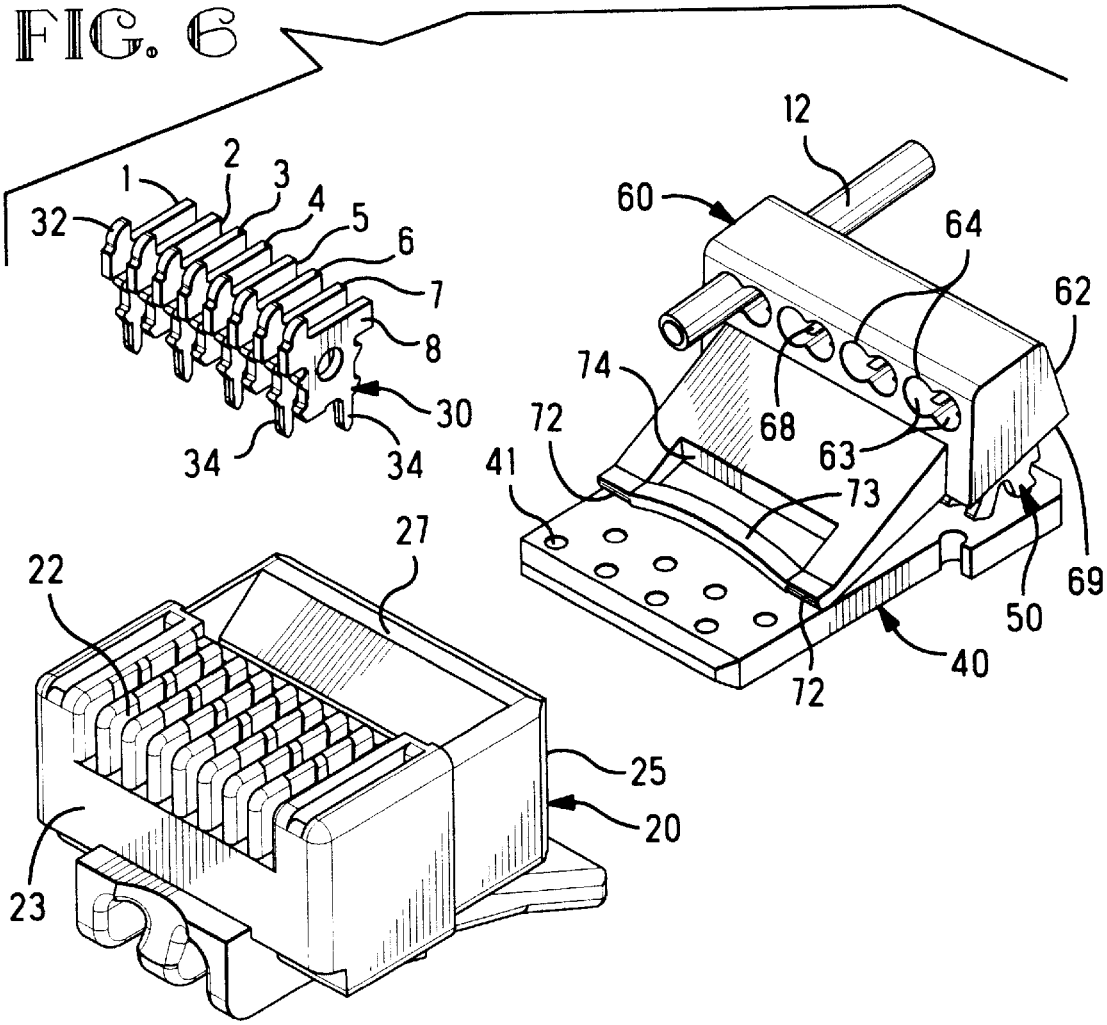

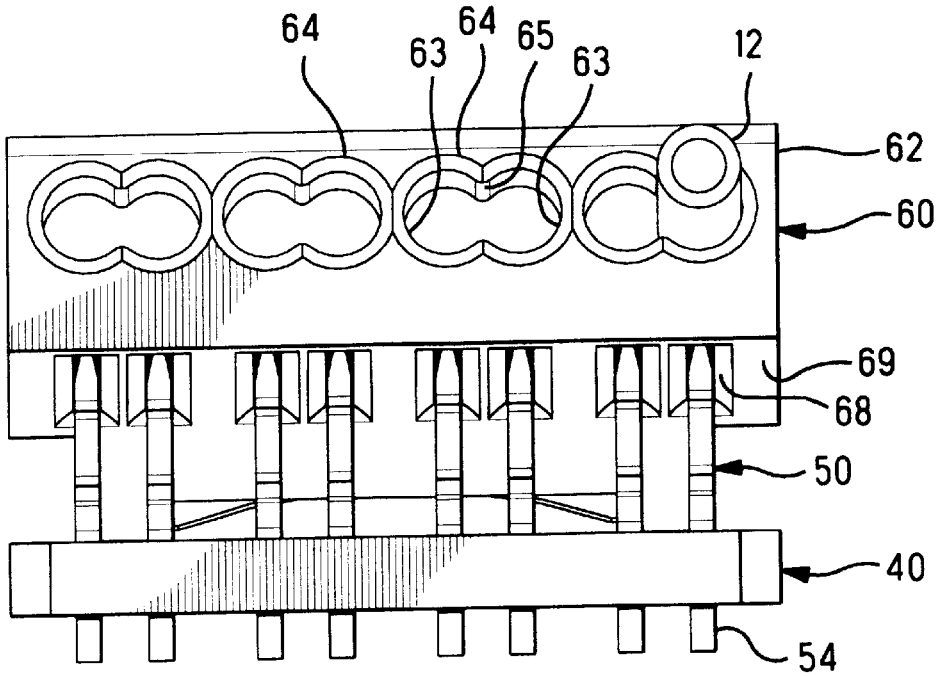
FIG. 7
FIG. 8
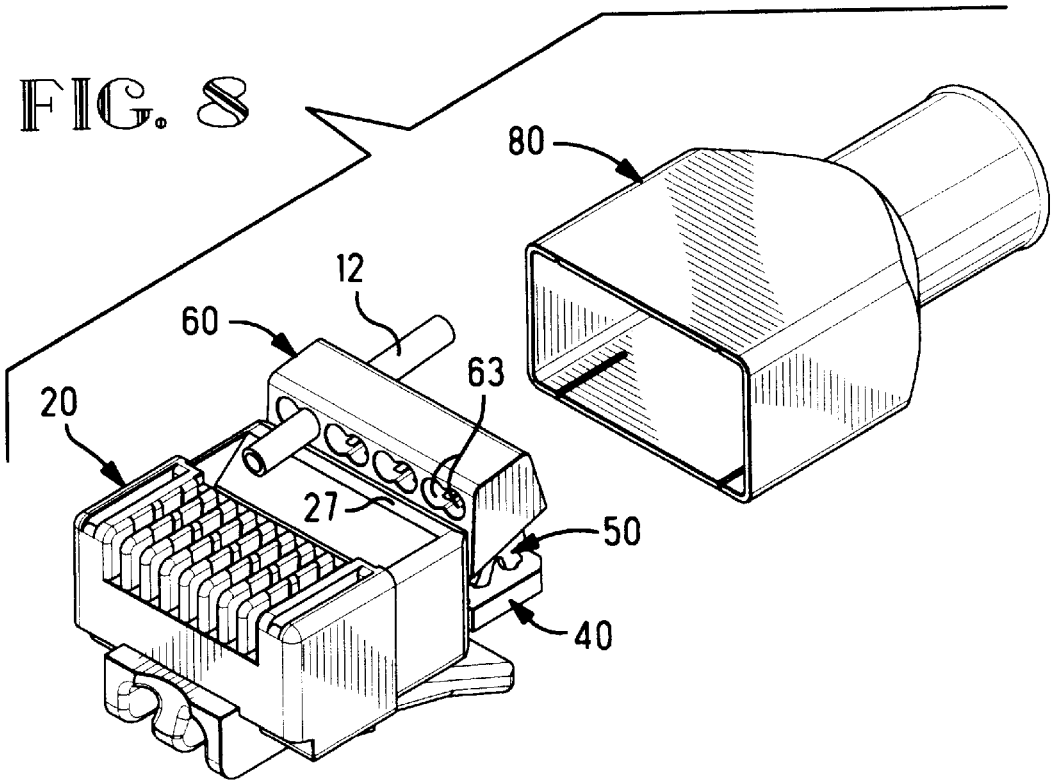

MODULAR PLUG HAVING A CIRCUIT BOARD

FIELD OF THE INVENTION

The invention relates to a modular plug electrical connector having a circuit board that is coupled between external communications wires and terminals in the connector.

BACKGROUND OF THE INVENTION

Modular plugs and modular jacks are commonly used for interconnecting plural wires in a communications system. Signal lines in a communications system are subject to crosstalk which increases in magnitude as operating frequencies of the system are increased. Previous efforts to reduce crosstalk have focused primarily on the crosstalk which occurs in the modular jack. A new standard promulgated by the Electronic Industries Association (EIA) sets crosstalk specifications for the modular plug.

A new concept for reducing crosstalk in a modular plug involves adding a compensating insert to the modular plug. Details of this new concept are disclosed in U.S. patent application Ser. No. 08/979,805 filed Nov. 25, 1997, which is owned by the assignee of the present application and which is incorporated by reference as if set forth fully herein. In at least one embodiment of the new crosstalk reduction concept, the compensating insert includes a circuit board which is installed in a cavity in the modular plug. The circuit board carries conductive traces which are arranged at one end of the board to be connected to communications system wiring, and at the other end of the board to be connected to terminals of the modular plug. A problem presented is how to connect the traces on the circuit board to the system wiring at one end and to the terminals of the modular plug at the other end. U.S. patent application Ser. No. 08/977,544 filed Nov. 25, 1997, which is owned by the assignee of the present application and which is incorporated by reference as if set forth fully herein, presents a solution to this problem. The present invention provides a different solution to the same problem.

SUMMARY OF THE INVENTION

A modular plug electrical connector according to the invention comprises a dielectric housing which holds a plurality of terminals that are engageable with terminals of a mating modular jack. A circuit board having an array of circuit holes is mounted in the housing.

According to one aspect of the invention, each of the terminals has a leg that extends into a respective one of the circuit holes for electrical connection with the circuit board and mechanical retention of the circuit board to the housing.

According to another aspect of the invention, the circuit board carries contacts for terminating wires of a communications system. The contacts are planar bodies that are arranged in respective parallel planes, and each of the contacts has a central axis that is inclined from a line that is perpendicular to the circuit board.

According to another aspect of the invention, the modular plug includes a stuffer cap having wire channels that are associated with the contacts. The stuffer cap is initially mounted on the circuit board in an open position wherein the wires can be installed in the wire channels, and the stuffer cap is pivotable to a closed position wherein the wires are urged into electrical connection with the contacts.

According to another aspect of the invention, the contacts are arranged in respective contact pairs, a space between contacts in a same said contact pair is less than a space between contacts in different said contact pairs, and the wire channels are arranged in siamesed pairs that are associated with respective ones of the contact pairs.

BRIEF DESCRIPTION OF THE DRAWINGS

The invention will now be described by way of example with reference to the accompanying drawings wherein:

FIG. 5 is a top plan view of a circuit board used in the modular plug;

FIG. 6 is a partially exploded isometric view showing a housing, terminals, stuffer cap and circuit board used in the modular plug;

FIG. 7 is a rear view of the stuffer cap and circuit board used in the modular plug;

FIG. 8 is an isometric view of the modular plug showing the stuffer cap in an open position and a wire disposed in the stuffer cap prior to being terminated:

DETAILED DESCRIPTION OF A PREFERRED EMBODIMENT

Figure 1:
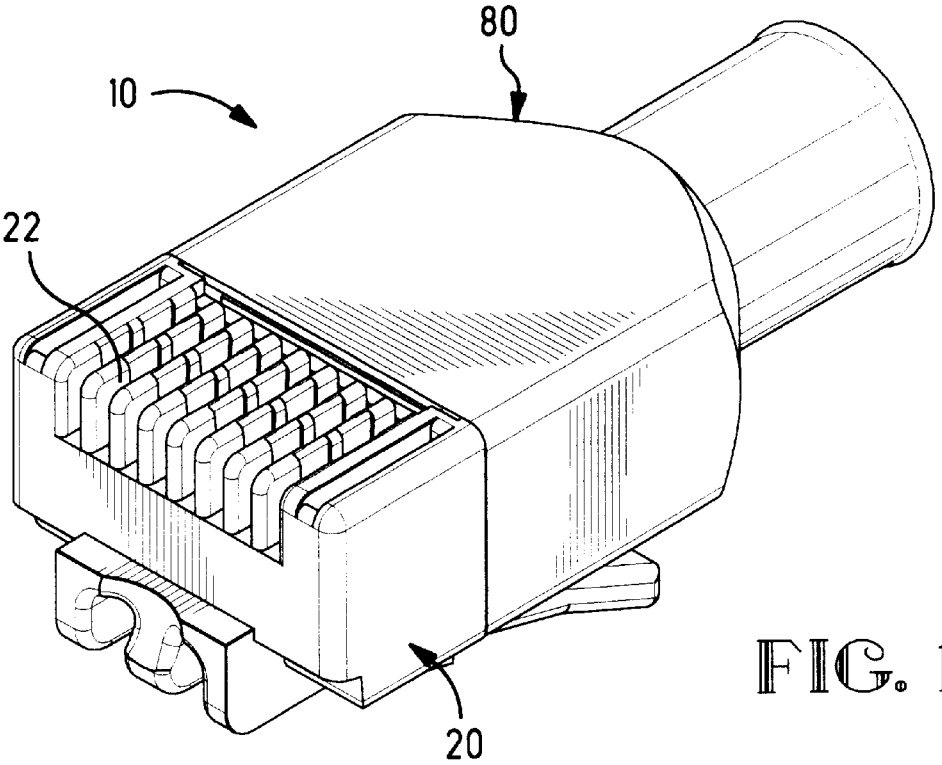
FIG. 1 is a top front isometric view of a modular plug electrical connector according to the invention.
Figure 2:
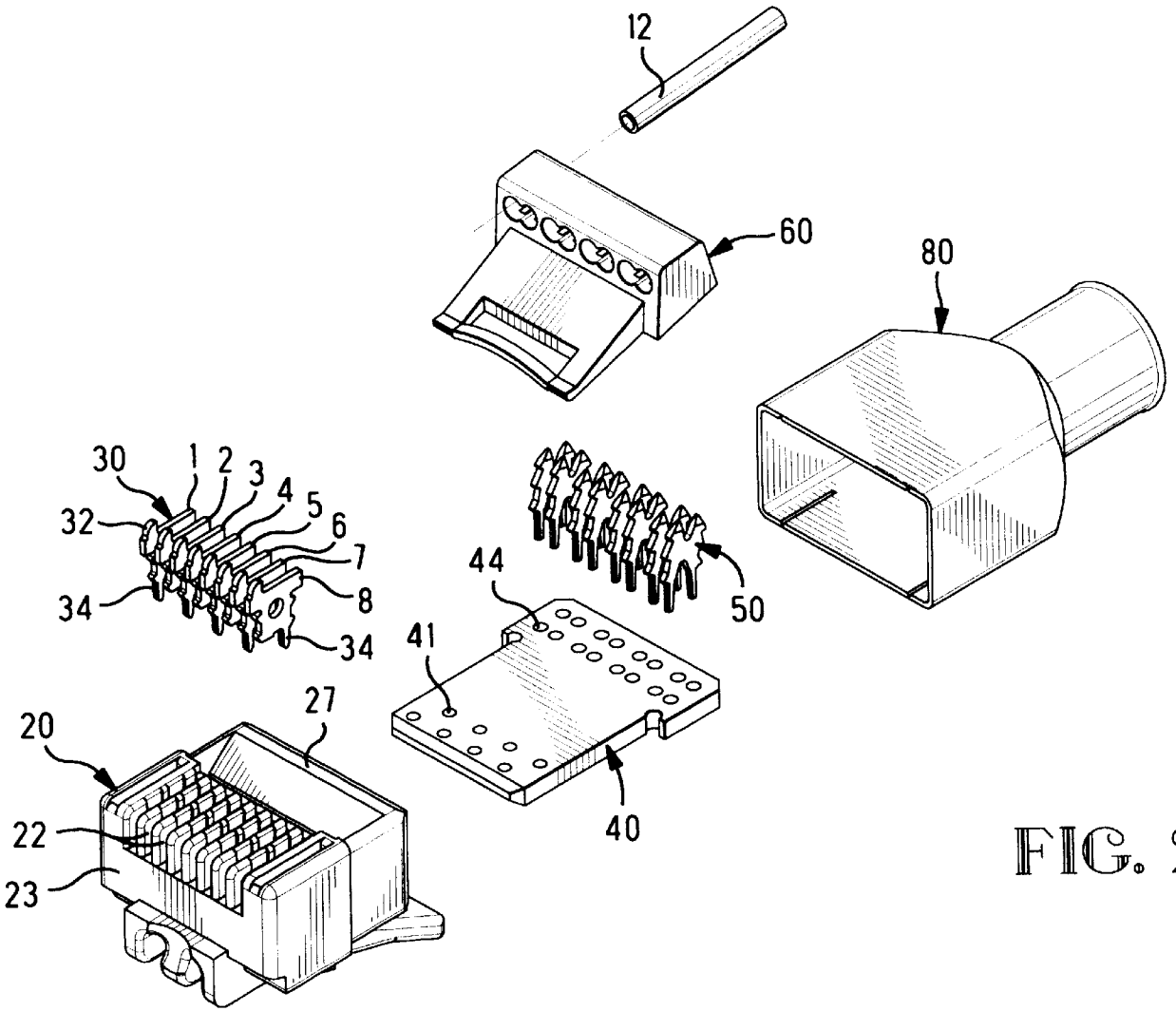
FIG. 2 is an exploded isometric view of the modular plug.

There is shown in FIGS. 1 and 2 a modular plug electrical connector 10 which is matable with a modular jack (not shown) for interconnecting a plurality of wires 12 (only one of which is shown) in a communications system. The wires in a communications system are typically twisted together in pairs which are associated as signal pairs, and the twisted pairs of wires are bundled within an insulative jacket. Each of the individual wires 12 includes a conductive core which is surrounded by a sleeve of insulation.

The modular plug connector 10 comprises a dielectric housing 20 which holds a plurality of terminals 30 that are arranged side-by-side in respective slots 22 at a forward end 23 of the housing. Each of the terminals 30 has a contact face 32 which is adapted for engaging a terminal in the modular jack, and a leg or tail 34 which is adapted for insertion in a hole in a circuit board 40. The number of terminals 30 corresponds to the number of wires 12 in the communications cable with which the modular plug is being used. The modular plug in the illustrated embodiment is an eight position electrical connector having eight terminals 30 which can be terminated to eight wires 12 of a standard four pair communications cable. However, it should be understood that the invention can be embodied in a modular plug which is configured for terminating any number of wires. The terminals 30 are assigned respective numbers 1 thru 8 corresponding to their positions in the housing, and these numbers 1 thru 8 in turn designate respective electrical paths which run through the terminals.

Figure 3:
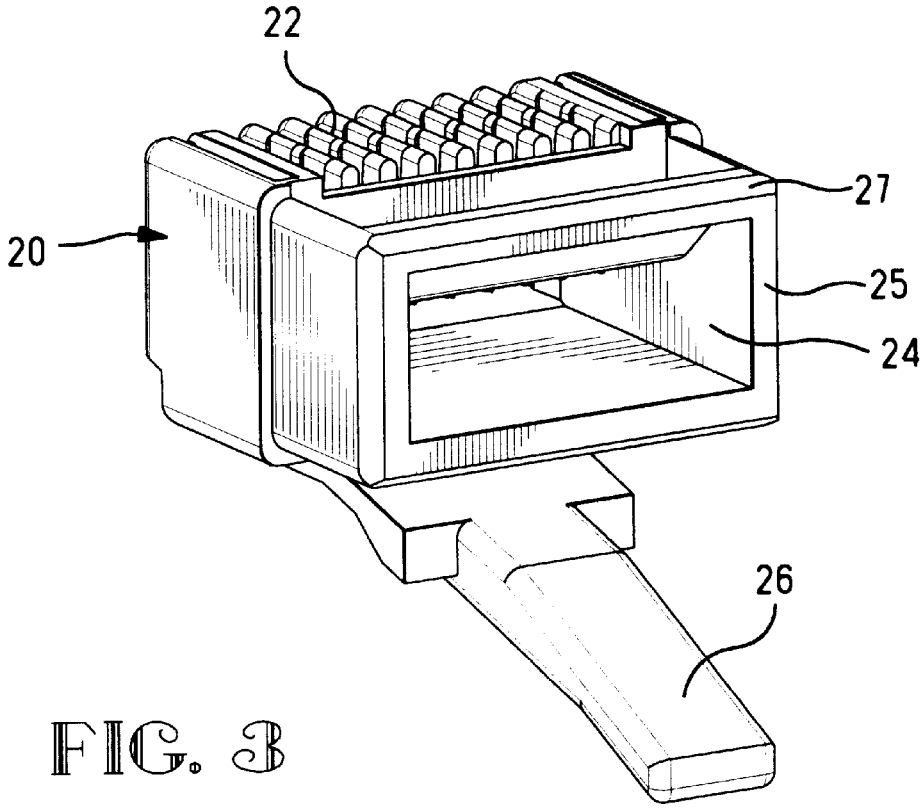
FIG. 3 is a rear isometric view of a housing used in the modular plug.
Figure 4:
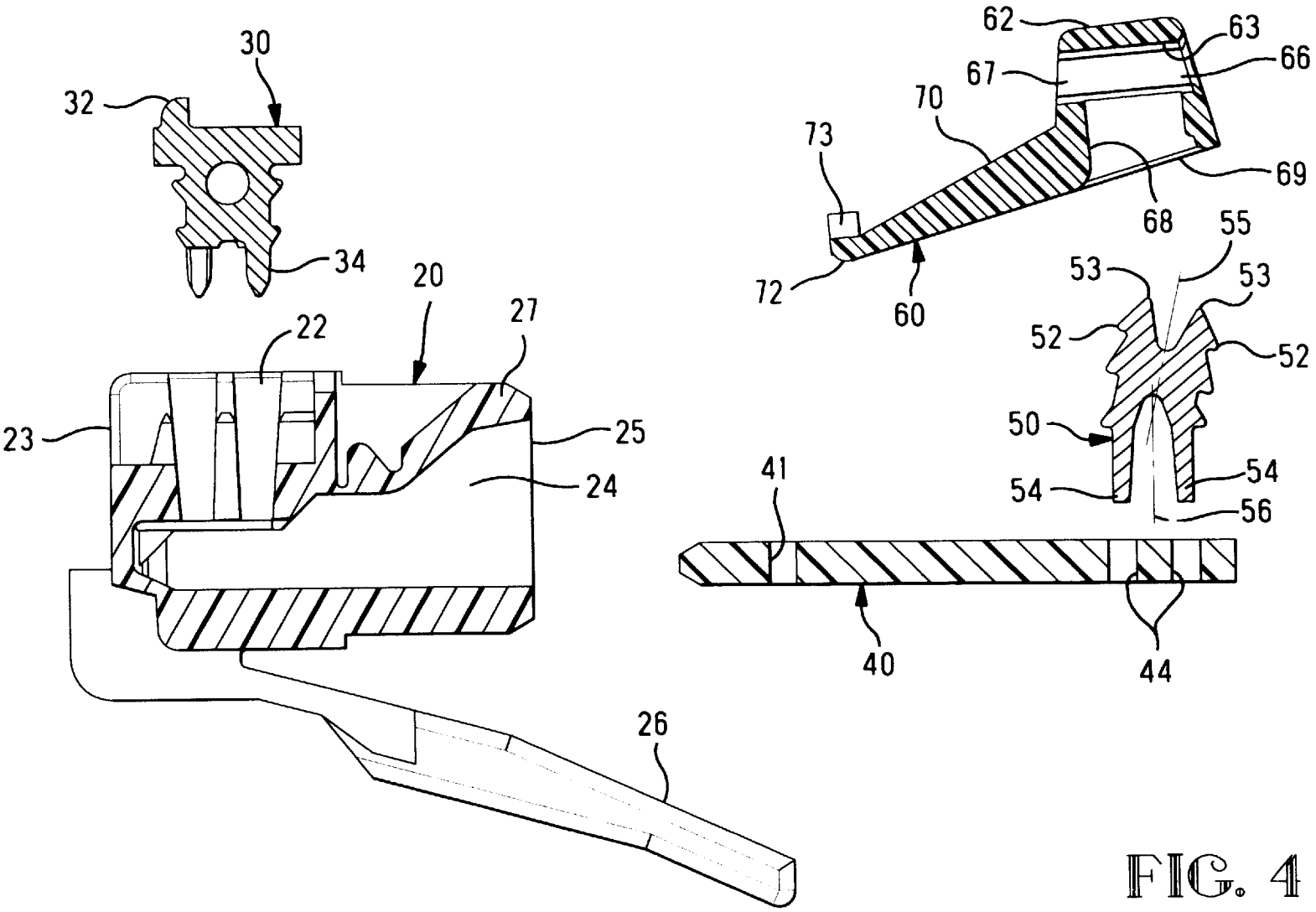
FIG. 4 is a cross-sectional view through components of the modular plug in exploded condition.

As shown in FIGS. 3 and 4, the housing 20 has a cavity 24 which opens into the housing through a rear face 25 of the housing. The cavity 24 is open to the slots 22 in an interior of the housing. The housing has a resilient latch arm 26 of known configuration which is operable to releasably secure the modular plug connector to the mating modular jack.

The circuit board 40 is mountable in the cavity 24 of the housing. As best seen in FIG. 5, the circuit board 40 has a first array of circuit holes 41 at a front or terminal end of the board. The circuit holes 41 are electrically connected to a second array of circuit holes 44 at a rear or wire end of the board by conductive traces (not shown). The conductive traces are arranged on the board in a spatial relationship that provides desired capacitive couplings between signal pairs so as to reduce crosstalk in the modular jack connector. A number of schemes which reduce crosstalk by routing of traces on a board are known, and all such schemes are considered to be within the scope of the invention.

Each of the circuit holes 41 in the first array is associated with one of the terminals 30 and may be assigned a respective number 1 thru 8 according to the number of its associated terminal 30. Each of the circuit holes 41 is preferably a plated circuit hole. The circuit holes 41 are arranged in two linear rows 42, 43 that are spaced-apart and extend laterally across the circuit board. Thus, the circuit holes 41 are longitudinally staggered as they extend laterally across the board in order to increase the density of circuit holes having a particular centerline spacing.

The circuit holes 44 in the second array are arranged in eight pairs corresponding to the eight wires which are to be terminated by the modular plug. Each of the circuit hole pairs comprises one circuit hole in lateral row 45 and one circuit hole in lateral row 46. It should be understood that only one circuit hole of each circuit hole pair is required to be electrically connected to a circuit trace on the circuit board. The circuit hole pairs are oriented in respective longitudinal rows such as rows 47, 48, 49, and all of the longitudinal rows extend parallel to each other. Further, the longitudinal rows are laterally spaced-apart at non-uniform distances. In particular, circuit hole pairs in longitudinal rows 47 and 48 which are associated with wires in a same twisted wire pair are spaced-apart by first distance D1, and circuit hole pairs in longitudinal rows 48 and 49 which are associated with wires in different twisted wire pairs are spaced-apart by a second distance D2 which is greater than the first distance D1. The distances D1 and D2 are on the order of 0.040 inch and 0.060 inch, respectively.

Figure 9:
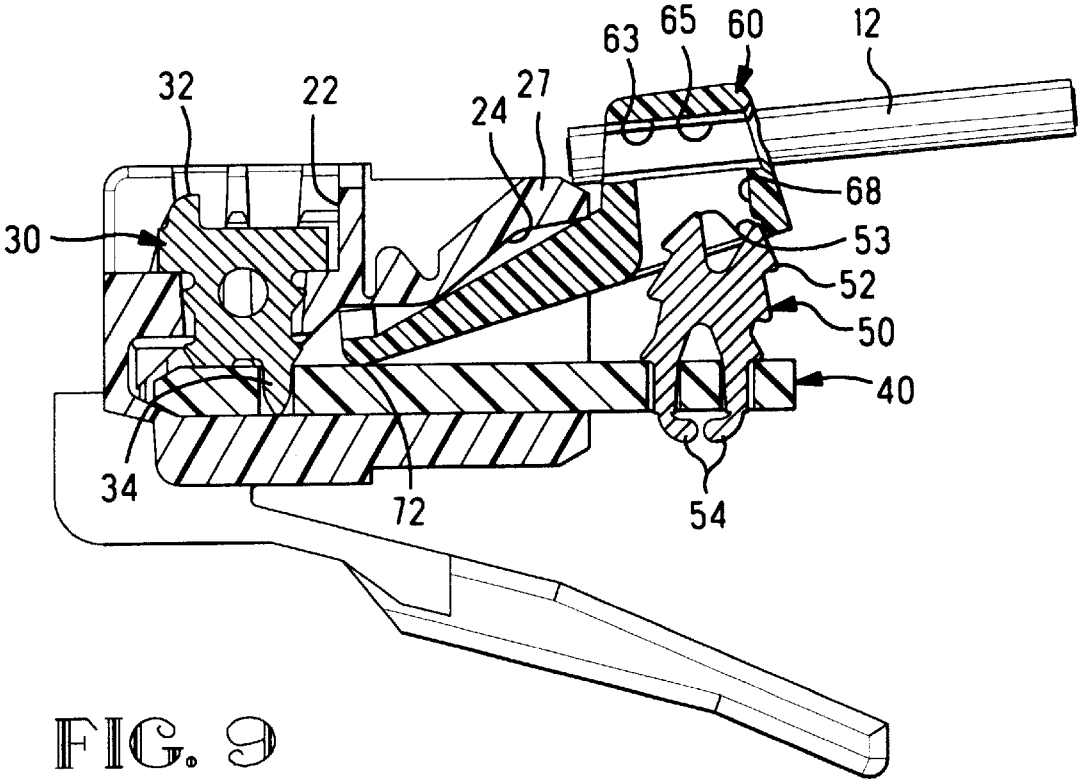
FIG. 9 is a cross-sectional view through the modular plug showing the stuffer cap in the open position prior to terminating a wire.

Referring back to FIGS. 2 and 4, a plurality of contacts 50 are mounted on the circuit board 40. Each of the contacts 50 is a planar body having an upper portion including a pair of arms 52 with tips 53 which are configured to pierce the insulation of one of the wires 12, and a lower portion including a pair of legs 54 which are initially straight to permit insertion of the legs through one of the pairs of circuit holes 44. After insertion, the legs 54 are bent as shown in FIG. 9 to clinch the circuit board 40 from below and thereby secure the contact 50 to the circuit board. When the contacts 50 are mounted on the board, the planar contact bodies are arranged in respective parallel planes and in respective contact pairs in accordance with the footprint of the circuit holes 44.

Figure 10:
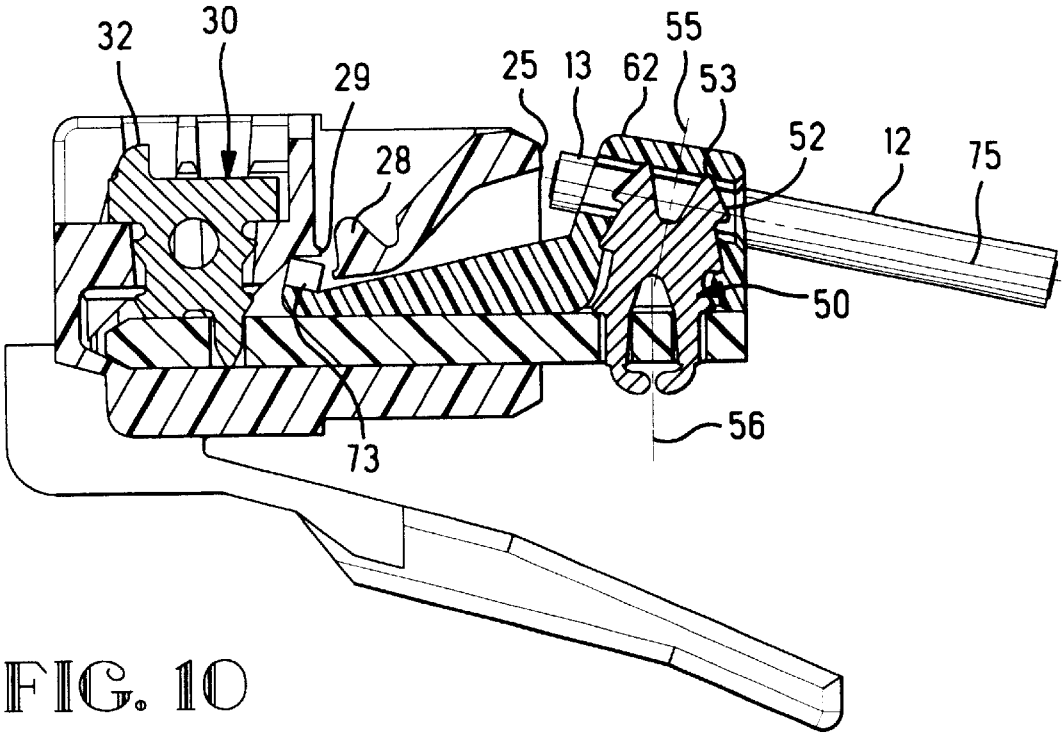
FIG. 10 is a cross-sectional view through the modular plug showing the stuffer cap in a closed position and the wire having been terminated.

A noteworthy feature of each contact 50 is that a central axis 55 between the pair of arms 52 is angled with respect to a central axis 56 between the pair of legs 54. A relative angle between the axes 55, 56 is approximately fifteen degrees. As a result, when the contact 50 is installed in the circuit board as shown in FIG. 10, the central axis 56 extends perpendicular to the circuit board and the central axis 55 is inclined with respect to the axis 56.

With reference to FIGS. 4, 6 and 7, the modular plug includes a stuffer cap 60. The stuffer cap includes a block member 62 having eight wire channels 63 each of which is dimensioned to receive one of the eight wires 12. The wire channels 63 are arranged in four siamesed pairs 64 that have an open wall at 65 between the paired wire channels. Each of the siamesed pairs 64 is intended to receive two wires of a same twisted wire pair. The wire channels 63 may be tapered in width as they extend axially through the block member 62. In particular, a cross-sectional dimension of the wire channel 63 in the vicinity of wire entrance 66 may be less than a cross-sectional dimension of the wire channel in the vicinity of wire exit 67, for a reason to be explained.

The stuffer cap 60 has eight slots 68 which are open from a bottom 69 of the stuffer cap into respective ones of the wire channels 63. Each of the slots 68 is dimensioned to closely receive one of the contacts 30.

The stuffer cap 60 includes a rigid plate member 70 having a free end which forms pivot members 72. The pivot members 72 are joined by a link 73 that spans an opening 74 in the plate member 70.

With reference to FIGS. 8 and 9, a circuit board subassembly comprising the circuit board 40, the contacts 50 and the stuffer cap 60 is installed in the cavity 24 in the housing 20. The stuffer cap is disposed in an initial or open position wherein the contacts 50 are partially within the slots 68 but have not entered the wire channels 63. The terminals 30, which are initially held in a pre-stage position in the slots 22, are driven downwardly so that the legs 34 of the terminals enter the circuit holes 41 in the circuit board. Thus, the legs 34 of the terminals serve to mechanically retain the circuit board in the housing and electrically engage with circuit paths on the circuit board. The tails 34 may be long enough to extend through the circuit board and into housing material below the circuit board to better retain the board in the housing. With the circuit board in this position, the stuffer cap 60 is trapped between a rear portion 27 of the housing and the contacts 50 which are partially within the slots 68. With the stuffer cap in the open position, pairs of the twisted wires 12 may be inserted in the siamesed pairs 64 of wire channels and pulled forwardly until the cable jacket abuts the rear of the block member 62, thereby minimizing any untwisted length of the wires.

With reference to FIG. 10, the stuffer cap is driven to a closed or final position with a suitable tool by pivoting the stuffer cap on the pivot members 72 (FIG. 9) in order to drive the tips 53 of the contact arms 52 through the cores of the wires 12, thereby electrically connecting the wires through the circuit board 40 to the terminals 30. Further, driving the contact arms 52 into the wires causes the insulation of each wire to swell in size, and the swollen insulation in combination with the tapered cross-section of the wire channel 63 results in a wedging action that serves to lock the wires 12 in the wire channels and to provide strain relief for the wires.

Concurrent with or subsequent to driving the stuffer cap to the closed position, a ledge 28 of the housing is sheared at connecting strip 29 and is driven downwardly behind the link 73 of the stuffer cap in order to provide supplemental retention of the stuffer cap to the modular plug.

It should also be noted that when the stuffer cap is in the closed position, a central axis 75 of each wire channel 63 is inclined with respect to the circuit board 40 and is perpendicular to the central axis 56 of the contact legs 54. The inclined axis 75 serves to expose an end 13 of the wire 12 in a gap between the stuffer cap block member 62 and the rear face 26 of the housing so that the wire end 13 can be trimmed away.

Finally, a metal shield 80 is installed over the stuffer cap and the rear portion of the housing. The metal shield protects the circuit board subassembly from contaminants and shields the signal paths from electromagnetic interference.

The invention provides a modular plug electrical connector having a circuit board which may include circuit traces that are routed to provide desired electrical couplings between selected circuits, thereby reducing electrical crosstalk in the connector. The circuit board is mechanically retained in the modular plug by terminals of the modular plug which are matable with terminals of a modular jack. The circuit board has contacts for connecting with wires of a communications system, and a stuffer cap for driving the wires into engagement with the contacts. Each of the contacts has a central axis which is inclined from perpendicular to the circuit board. The stuffer cap has wire-receiving channels which are arranged in siamesed pairs which receive twisted wire pairs, thereby minimizing any untwisted length of the wires.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A modular plug electrical connector comprising:

a dielectric housing which holds a plurality of terminals that are engageable with terminals of a mating modular jack; and a circuit board mounted in said dielectric housing, the circuit board having an array of circuit holes, wherein each of the terminals has a contact face, for engaging a terminal in the mating modular jack, and a leg, that extends into a respective one of the circuit holes for electrical connection with the circuit board and mechanical retention of the circuit board to the housing, said contact face and said leg located in the same plane.

2. The modular plug electrical connector of claim 1 wherein the terminals are arranged in respective parallel planes, and the legs of the terminals are arranged in two linear rows that extend perpendicular to the planes.

3. The modular plug electrical connector of claim 1 wherein each of the legs extends through the circuit board and engages in a wall of the housing on an opposite side of the circuit board.

4. The modular plug electrical connector of claim 1 wherein the circuit board carries contacts for terminating wires of a communications system.

5. The modular plug electrical connector of claim 4 wherein the contacts are planar bodies that are arranged in respective parallel planes.

6. The modular plug electrical connector of claim 5 wherein each of the contacts has a central axis that is inclined from a line that is perpendicular to the circuit board.

7. The modular plug electrical connector of claim 5 wherein the contacts are arranged in respective contact pairs, and a space between contacts in a same said contact pair is less than a space between contacts in different said contact pairs.

8. The modular plug electrical connector of claim 7 further comprising a stuffer cap having wire channels that are associated with the contacts, the stuffer cap being initially mounted on the circuit board in an open position wherein the wires can be installed in the wire channels, and the stuffer cap being movable to a closed position wherein the wires are urged into electrical connection with the contacts, the wire channels being arranged in siamesed pairs that are associated with respective ones of the contact pairs.

9. The modular plug electrical connector of claim 8 wherein the wire channels are inclined with respect to the circuit board when the stuffer cap is in the closed position.

10. The modular plug electrical connector of claim 8 wherein each of the wire channels has a cross-sectional dimension which is non-uniform as the wire channel extends axially.

11. A modular plug electrical connector comprising:

a dielectric housing which holds a plurality of terminals that are engageable with terminals of a mating modular jack;

a circuit board mounted in said dielectric housing, the circuit board having a terminal end that is electrically connected to the terminals, and an opposite wire end including contacts that are engageable with wires of a communications system; and a stuffer cap having wire channels that are associated with the contacts, the stuffer cap being initially mounted on the circuit board in an open position wherein the wires can be installed on the wire channels, and the stuffer cap being pivotable to a closed position wherein the wires are urged into electrical connection with the contacts.

12. The modular plug electrical connector of claim 11 wherein the wire channels are inclined with respect to the circuit board when the stuffer cap is in the closed position.

13. The modular plug electrical connector of claim 11 wherein each of the wire channels has a cross-sectional dimension which is non-uniform as the wire channel extends axially.

14. The modular plug electrical connector of claim 11 wherein the contacts are planar bodies that are arranged in respective parallel planes.

15. The modular plug electrical connector of claim 14 wherein each of the contacts has a central axis that is inclined from a line that is perpendicular to the circuit board.

16. The modular plug electrical connector of claim 14 wherein the contacts are arranged in respective contact pairs, and a space between contacts in a same said contact pair is less than a space between contacts in different said contact pairs.

17. The modular plug electrical connector of claim 16 wherein the wire channels are arranged in siamesed pairs that are associated with respective ones of the contact pairs.

* * * * *